United States Patent [19]

Willenborg

[11] Patent Number: 4,482,200

[45] Date of Patent: Nov. 13, 1984

[54] CONNECTOR BOX

[75] Inventor: James F. Willenborg, Santa Clara, Calif.

[73] Assignee: INMAC, Santa Clara, Calif.

[21] Appl. No.: 402,506

[22] Filed: Jul. 28, 1982

[51] Int. Cl.[3] ..... H01R 13/58

[52] U.S. Cl. ..... 339/103 M; 339/125 R; 339/210 M

[58] Field of Search ..... 339/103 R, 103 CM, 156 R, 339/207-210 M, 184 M, 92 R, 92 M, 105, 107, 122, 125 R, 119 R

[56] References Cited

U.S. PATENT DOCUMENTS 3,904,265 9/1975 Hollvday et al. ..... 339/208 X
4,210,380 1/1980 Briostek ..... 339/107
4,290,664 9/1981 Davis et al. ..... 339/125 R X
4,303,296 12/1981 Spaulding ..... 339/122 R

FOREIGN PATENT DOCUMENTS 2141064 3/1973 Fed. Rep. of Germany ..... 339/107
170982 4/1966 Sweden ..... 339/107

*Primary Examiner*—Eugene F. Desmond
*Attorney, Agent, or Firm*—Baker & McKenzie

[57] ABSTRACT

A connector box having a removable connector plate is disclosed. The connector box provides a mounting means for positioning a cable connector on a surface such as a wall or floor. With the present invention, it is possible to mount a cable having a prefixed cable connector without removing the connector from the cable.

9 Claims, 2 Drawing Figures

CONNECTOR BOX

TECHNICAL FIELD

This invention relates to connector boxes and more particularly to connector boxes used to retain a cable having a cable connector previously fixed on one end.

BACKGROUND OF THE INVENTION

In recent years there has been a growing popularity in the use of various electronic systems in such settings as offices, hospitals, and factories. These electronic systems, which include word processing equipment and computers, require that their various components, such as a main unit and user units, be connected with bulky cables. Each unit is provided with a length of cable fitted with a cable connector. To associate the units, the cable connectors are "plugged in" to each other or plugged into an appropriate extension cable.

Unfortunately, it is difficult if not impossible to install those extension cables in existing walls of an office. The cables are generally directed along the outside of the walls and have cable connectors on each end which cooperate with the corresponding cable connectors on the units being "plugged in." It is desirable to fix the position of these cables and in particular fix the position of their cable connectors to gain the benefits of having a fixed socket into which a unit may be connected.

However, these cable connectors come in various shapes and sizes, and it would be expensive to provide different devices for mounting each particular type of cable connector. Prior devices are generally adapted to only retain a particular configuration of connector. This not only adds to the expense of inventory, but also makes replacement of one type of connector with another impossible without also replacing the entire device.

It is desirable to provide a device which avoids the deficiencies of the prior art and provides a device which is easily adaptable to mount a variety of cable connectors and permit replacement of one type of connector with another without having to replace the entire device. The present invention meets these desires.

SUMMARY OF THE INVENTION

The present invention is a connector box which provides a means for mounting a cable connector on a surface. In the preferred embodiment, the connector box generally comprises a cover member removably attached to a base which member and base together define a chamber and a passage into the chamber of sufficient size to receive a cable. The base and cover member are each provided with connector plate retaining means which together retain a connector plate when the cover member is removably attached on the base. The connector plate defines a chosen aperture to receive a cable connector with the connector mounted on the connector plate.

The base is adapted to be fixed to the desired surface. A cable connector is mounted on a chosen connector plate having a matching aperture and retained on the connector box with the cable extending through the passageway. The two part base and cover design allows a cable connector to be mounted without having to first be removed from the cable.

This connector box has several advantages. It permits a cable connector to be fixed with respect to a surface without having to make major modifications in that surface such as placing a large hole in a wall. Thus, it is possible to easily "plug in" a corresponding complementary cable connector into the cable connector which has been mounted by the connector box.

The connector box, because of its unique design, permits the interchangeability of different connector plates adapted to receive different cable connectors while using the same remaining components. The same base and cover member are used for a wide variety of cable connectors, only the connector plate need be changed if necessary. The base can be permanently fixed to the surface, if desired, and the connector plate can be easily replaced to meet new circumstances. There is not only an initial savings in an installation using such a connector box because of reduced inventory, but there is also a savings when a later change is made in the type of connectors being used.

Numerous other advantages and features of the present invention will become readily apparent from the following detailed description of the invention, the accompanying example, and the appended claims.

DETAILED DESCRIPTION OF THE PREFERRED EMBODIMENT

Figure 1:
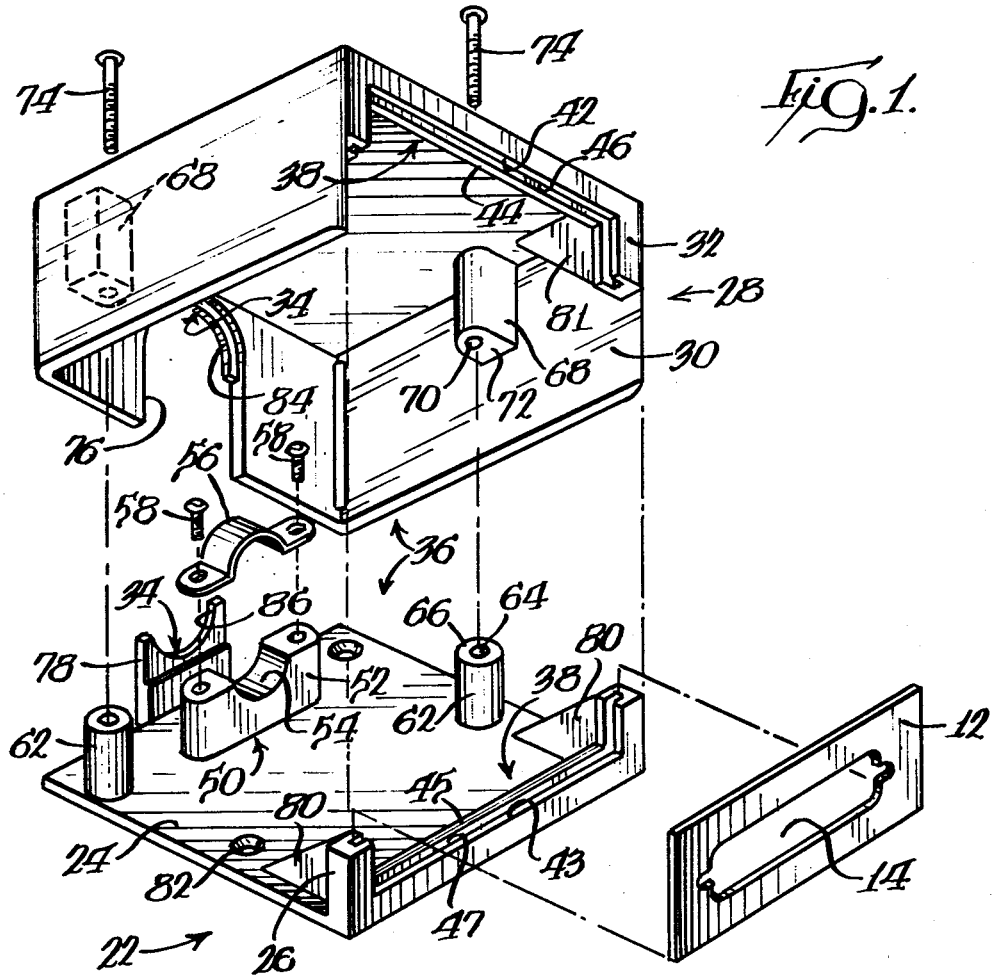
FIG. 1 is an exploded perspective view showing the components of a preferred embodiment of a connector box.

While this invention is susceptible of embodiment in many different forms, there is shown in the drawing and will be described in detail, one specific embodiment, with the understanding that the present disclosure is to be considered as an exemplification of the principles of the invention and is not intended to limit the invention to the embodiment illustrated.

The precise shapes and sizes of the components described are not essential to the invention unless otherwise indicated. For ease of description, the connector box shown will be described in an upright position and such terms as top, bottom, etc. will be used with reference to this position. It will be understood, however, that the connector box may be used in any orientation.

Figure 2:
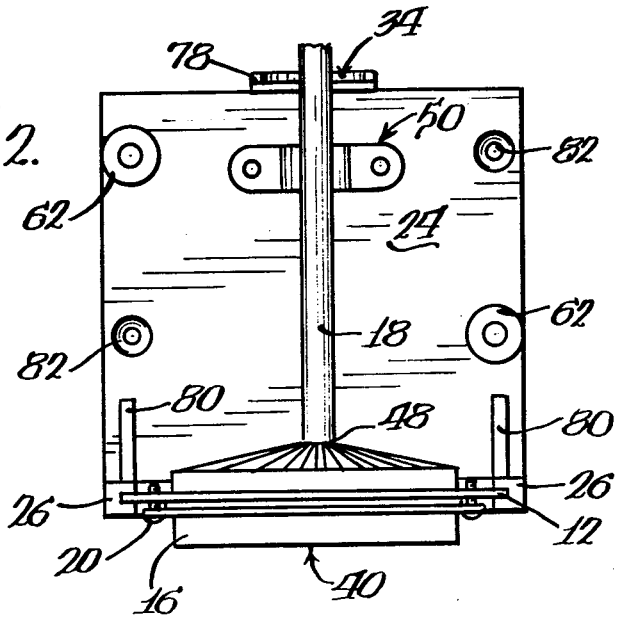
FIG. 2 is a top plan view showing a cable connector mounted on some of the components of the connector box shown in FIG. 1.

The present invention is a connector box which may be mounted on a surface such as a floor, wall, table or the like for retaining a cable having a cable connector fixed on one end such that the cable connector is substantially immobilized with respect to that surface. Referring to the Figures, the connector box has a removable connector plate 12 which defines an aperture 14 chosen to receive a specific configuration of cable connector with the connector mounted on the connector plate. This can best be seen in FIG. 2 where a cable connector 16 having a cable 18 is shown received within aperture 14 and mounted to the cable connector 12 by fasteners such as screws 20. The connector plate 12 is preferably made of a flat piece of metal such as sheet steel; however, other materials of construction having the requisite rigidity and strength may be utilized.

The connector box also has a base unit 22 which includes a base 24 adapted to be mounted on a surface to provide support for the connector box and an upstanding first connector plate retaining means 26 integral with the base 24. The connector box also includes a cover unit 28 which includes a cover member 30 removably attachable on the base 24 and a second connector plate retaining means 32 integral with the cover member 30. Base unit 22 completely surrounds the periphery of connector plate 12.

The cover unit 28, i.e., the cover member 30 and the second connector plate retaining means 32, together with the base unit 22, i.e., the base 24 and the first connector plate retaining means 26, define a box combination. Each connector plate retaining means can be unitary with its respective base or cover member.

One side of the box combination defines a passage 34 of sufficient size to permit the cable to pass through the one side into a chamber 36 defined by the box combination. When the cover member 30 is attached to the base 24 (i.e. the cover unit 28 is attached to the base unit 22), the first and second plate retaining means cooperate to define a hole 38 into the chamber 36 and also cooperate to removably retain the connector plate 12 in a substantially fixed position with respect to the base 24. The base and cover member are preferably substantially rectilinear with the hole 38 and the passage 34 situated at opposite sides of the box combination.

The bulk of the cable connector 16 can be received into chamber 36 with its connecting face 40 adjacent the hole 38 and the cable extending out through passage 34. This produces a neat appearance which is important in an office setting, while also protecting the cable connector 16 and its junction 48 with the cable.

A cable connector such as 16, when mounted on the connector plate 12, is held in a fixed position with respect to the surface on which the connector box is mounted. Because the connector plate 12 is removably retained, it can be removed to permit the easy mounting of a new cable and cable connector without disturbing the mounting of the box connector box itself. The connector plate 12 can also be easily replaced with a different connector plate having an aperture chosen to receive a cable connector of a different configuration. This reduces the cost of changing electronic systems.

Preferably each connector plate retaining means includes a pair of substantially parallel lips 42, 43 and 44, 45 which define juxtaposed channels 46, 47 to slidably receive the connector plate 12. This deters movement of the received connector plate 12, not only from side to side, but also deters movement into and away from the box combination. The lips 42, 43 and 44, 45 which preferably surround, i.e., extend substantially about, the entire hole 38, provide a relatively large surface area for retaining the connector plate 12. This permits the connector 16 from being accidentally torn off of the connector plate retaining means such as when cable 18 is stressed, e.g., when someone trips over cable 18. Preferably the channels 46, 47 lie substantially in the same plane when the cover member 26 is attached to the base unit 22. The connector plate retaining means 26 and 32 may be additionally supported as by braces 80 and 81 to further strengthen them.

The connector box may also be provided with a cable strain relief means 50 on the base unit 22 for holding the cable so as to prevent strain on the cable-connector junction 48, i.e., where the cable 18 connects to the cable connector 16, as that portion of the cable outside the connector box is moved relative to the box combination. The strain relief means 50 preferably includes a pedestal 52 on the base unit 22 and defining a cylindrical cut-out or groove 54 adapted to receive the cable, and a clamp piece 56 to be fastened on the pedestal as by fasteners or screws 58 and cooperating with the pedestal for holding the cable. Pedestal 52 may be molded as part of base 24 or mounted thereon, as desired. Should undue tension be placed on the cable that could otherwise cause damage to the cable connector junction 48, the strain relief means 50 prevents this tension from being passed on to that junction.

Preferably at least one boss or standard 62 is fixed on the base 24 and defines a bore 64 and an abutment surface 66. Corresponding to this standard is at least one other standard 68 on the cover member 30, and also defining a bore 70 and an abutment surface 72. The standard 68 on the cover member may be integral with a wall of the cover member to provide mutual support. The standards are positioned on their respective members such that when the cover member 30 is removably attached to the base 24, the standards are in registry and the abutment surfaces 66, 72 abut. The cover member 30 may then be removeably attached to the base 24 a fastener such as screw 74 which extends through the bores 64, 70. The screw 74 can extend through bore 70 and engage with bore 64 or pass through both bores and engage with the surface below the base 24. The base may be additionally fixed on a given support surface by fasteners extending through opening 82.

The standards 62, 68 provide a valuable function. They maintain the spacing of the cover member 30 and base 24 to prevent the screw 74 from collapsing the cover member as it is applied. Thus, should attempts be made to in effect screw down the cover member 30 too tightly, the cover member will not collapse, but rather the pressure is transferred directly through the standards to the surface on which the base 24 is mounted.

It is also desirable that the cover member 30 define a slot 76 on the one side and that the base 24 define a tongue 78 which extends from the base 24 toward the cover member 30 so as to be received within the slot 76 when cover member is attached to the base. The slot 76 and tongue 78 together define the passage 34. This slot 76 and tongue 78 configuration defines a substantially circular passage 34 which is positioned centrally from top to bottom on the connector box. This arrangement clamps the structural elements defining the passage 34 about the cable without placing an under strain on the cable. A portion of the slot 76 can also include a ridge 84 having a thickness less than the thickness of the walls of the cover member. This provides a reduced surface area which can contact with and engage the cable and to provide additional strain relief. The tongue 78 can also have a similar ridge 86.

In use, the base 24 is mounted on a surface such as a wall, floor, or table for mounting. A connector plate 12 having a desired aperture is chosen and the cable 18 is passed through the aperture with the cable connector 16 mounted on the cable connector plate. The connector plate 12 is then slidably inserted in and retained by the first connector plate retaining means 26 such as by being inserted into the channel 47 of that connector retaining means. The cable then extends through the box assembly and out through the passage 34. If desired, the strain relief means 50 may be used as by placing clamp piece 56 over the cable 18 and securing it in place.

The cover member 30 is then positioned over the base with the connector plate also being retained by the second connector retaining means 32 as by being received in channel 46. The cover member is then removably attached to the base as by screw 74. Should it become desirable to change cables and cable connectors, the cover member need only be removed and a new cable connector can be mounted on the old connector plate, or if it is of a different configuration, a new connector plate may be provided. Thus, it is unnecessary to change the box combination when changing cables of connectors even when those cable connectors have different configurations. This not only provides simplicity in installing an electronic system, but also reduces the cost of needed inventory to meet the needs of different cable connectors for multi-conductor, non-primary power cables as well as reducing the cost of changing electronics systems.

The foregoing specification is intended as illustrative and is not to be taken as limiting. Still other variations within the spirit and scope of this invention are possible and will readily present themselves to those skilled in the art.

What is claimed is:

1. A connector box for retaining a cable having a cable connector fixed on one end at a cable connector junction, which cable and connector may be easily removed from the connector box, the connector box comprising in operative association:

(a) a base adapted to be mounted on a surface to provide support for the connector box;

(b) a first connector plate retaining means on the base;

(c) a cover member removably attached on the base;

(d) a second connector plate retaining means on the cover member; and (e) a connector plate defining a chosen aperture for receiving the cable connector with the cable connector mounted to the connector plate, the connector plate being associated with the first and second connector plate retaining means;

said first and second connector plate retaining means including a pair of substantially parallel lips defining a channel to receive the connector plate, the channels of both connector plate retaining means being substantially coplanar when the cover member is attached to the base, said first and second connector plate retaining means defining a hole on a first side when the cover member is attached to the base, said channels together extending substantially around the periphery of the hole;

the base, cover member and both connector plate retaining means defining a box combination having an internal chamber; the box combination on a second side defining a passage of sufficient size to pass the cable through the second side into the chamber and across the base to the connector mounted on the first side, the first and second connector plate retaining means cooperating to removably retain the connector plate in a substantially fixed position with respect to the base whereby one end of the cable is fixed relative to the surface when the connector for the cable is mounted on the connector plate, thus permitting a corresponding complementary connector to be mated with and disconnected from the cable connector without placing undue strain on the cable, the cable and connector being easily removed from the connector box, the connector box then being able to receive another cable with a connector of different configuration.

2. The connector box of claim 1 including a fastner to removably attach the cover member to the base, and at least two opposed standards each defining a bore and an abutment surface, one of the standards being fixed on the base and other on the cover member such that the standards are in registry and the abutment surfaces abut when the cover member is attached to the base whereby the standards maintain the spacing of the cover member and base and prevent the fastener from collapsing the cover member as the fastener is secured to the base through the bores.

3. The connector box of claim 1 wherein the first connector plate retaining means is integral with the base to define a base unit and the second connector plate retaining means is integral with the cover member to define a cover unit.

4. The connector box of claim 1 including strain relief means fixed on the base for holding the cable to substantially prevent strain on the cable connector junction as tension is placed on that portion of the cable outside the box combination.

5. The connector box of claim 4 wherein the strain relief means includes a pedestal on the base and defining a groove adapted to receive the cable, the strain relief means also including a clamp piece to be fastened on the pedestal and cooperating with the pedestal to hold the cable.

6. A connector box for retaining a cable having a cable connector fixed on one end at a cable connector junction, the connector box comprising in operative association:

(a) a base unit adapted to be mounted on a surface to provide support for the connector box, the base unit defining a tongue on a first side;

(b) a cover unit removably attached to the base unit to form a box combination having an internal chamber, the cover unit defining on a first side a slot within which the tongue is received, the tongue and slot together defining a passage of sufficient size to pass the cable through the first side into the chamber, the box combination defining a hole on a second side of the box combination and defining substantially completely around the hole, a channel lying substantially in a plane; and (c) a connector plate defining a chosen aperture for receiving the connector, the connector plate being received and held by the channel;

whereby the cable connector can be mounted on the cable connector plate and the plate positioned within the channels with the cable extending through the passageway, permitting a corresponding complementary cable connector to be mated with and disconnected from the cable connector without placing undue strain on the cable and also permitting different cables having different configurations of cable connectors to be mounted on the surface without changing or removing the base from the surface.

7. The connector box of claim 6 wherein the base unit and cover unit are substantially rectilinear and the hole and passage are on opposite sides of the box combination.

8. The connector box of claim 6 wherein the cover unit defines a wall on said first side having a certain thickness, said slot having an upper ridge whose thickness is less than the wall thickness, said tongue being of a certain thickness generally, and having terminal ridge portion of reduced thickness, the ridge and the terminal ridge portion coacting to engage the cable so as to provide a strain relief means.

9. A combination connector box, cable and cable connector, wherein the cable is pre-fixed to the cable connector and the connector box comprises a base, a cover and a connector plate, the base being adapted to be mounted on a surface to provide support for the combination, and defining a tongue on a first side, a base connector plate retaining means on a second, opposite side, and a first cable strain relief means intermediate the first and second sides, the cover being removably attached to the base, and defining a slot on a first side and a cover connector plate retaining means on a second, opposite side, the connector plate defining a chosen aperture for receiving the connector, the cover and base connector plate retaining means together forming a hole and a channel extending substantially around the hole, the slot and tongue together forming a passage and a second cable strain relief means for the cable, the connector plate being received and held by the channel, the cable extending across the box from the connector to the passage and out of the passage to the exterior of the connector box, whereby a corresponding complementary cable connector may be mated to and disconnected from the cable connector without placing undue strain on the cable, and also permitting different cables having different configurations of cable connectors to be mounted on the surface without changing or removing the base from the surface.

* * * * *